United States Patent [19]

Yebisuya et al.

[11] 4,406,698

[45] Sep. 27, 1983

[54] MARTENSITIC STAINLESS CAST STEEL HAVING HIGH CAVITATION EROSION RESISTANCE

[75] Inventors: Takashi Yebisuya, Kawasaki; Masao Yamamoto, Tokyo; Mituo Kawai; Koichi Tajima, both of Yokohama, all of Japan

[73] Assignee: Tokyo Shibaura Denki Kabushiki Kaisha, Kawasaki, Japan

[21] Appl. No.: 256,120

[22] Filed: Apr. 21, 1981

[30] Foreign Application Priority Data

| | | | |
|---|---|---|---|
| Apr. 28, 1980 | [JP] | Japan | 55-56507 |
| Apr. 28, 1980 | [JP] | Japan | 55-56508 |
| Jul. 16, 1980 | [JP] | Japan | 55-96236 |

[51] Int. Cl.[3] ..... C22C 38/58; C22C 38/42; C22C 38/48

[52] U.S. Cl. ..... 75/125; 75/126 B; 75/128 A; 148/37; 415/212 A

[58] Field of Search ..... 75/128 A, 128 W, 126 B, 75/125; 148/37, 38, 135, 136; 415/212 A

[56] References Cited

U.S. PATENT DOCUMENTS

| | | | |
|---|---|---|---|
| 2,999,039 | 9/1961 | Lula et al. | 148/37 |
| 3,385,740 | 5/1968 | Baggström et al. | 148/135 |
| 3,925,064 | 12/1975 | Takamura et al. | 75/128 A |
| 4,256,486 | 3/1981 | Yoshioka et al. | 75/126 B |
| 4,326,885 | 4/1982 | Larson et al. | 148/37 |

FOREIGN PATENT DOCUMENTS

| | | | |
|---|---|---|---|
| 2551719 | 9/1976 | Fed. Rep. of Germany | 75/128 W |
| 1576975 | 8/1969 | France | 75/128 G |
| 55-161051 | 12/1980 | Japan | 75/128 W |
| 1236698 | 6/1971 | United Kingdom | 75/128 A |

*Primary Examiner*—Peter K. Skiff

*Attorney, Agent, or Firm*—Oblon, Fisher, Spivak, McClelland & Maier

[57] ABSTRACT

Martensitic stainless cast steel suitable for use as turbine elements for water power plants having high cavitation erosion resistance and consisting essentially of carbon of 0.1 wt % or less, silicon of 1.0 wt % or less, manganese of 2.0–9.0 (exclusive of 2.0) wt %, nickel of 0.5–8.0 wt %, chromium of 11.0–14.0 wt %, and the balance of essentially iron.

17 Claims, 2 Drawing Figures

MARTENSITIC STAINLESS CAST STEEL HAVING HIGH CAVITATION EROSION RESISTANCE

The present invention relates to martensitic stainless cast steel suitable for use as water turbine elements for water power plants such as runner, guide vane and stay vane which are required to have high cavitation erosion resistance.

Output per unit power generator in thermal and atomic power generators has the trend of becoming larger and larger these days, but it is difficult for thermal and atomic power plants having such large output to weather through peak load of electric power. As one step to weather through such peak load, there has become popular construction of water power plants capable of adjusting output in a comparatively short time period, particularly construction of pumped-storage power plants capable of efficiently using excess power at night.

The water turbine employed in these pumped-storage power plants is the so-called "reversible pump turbine" which functions to perform both generating operation by day and pumping operation by night, and these power plants have the trend of having high head and high output for the purpose of efficiently using the construction site and reducing the construction cost per unit output, etc.

Cast steel (13-chromium cast steel) containing mainly chromium of about 13 wt% has conventionally been used as material for water turbine elements such as water turbine runner, guide vane and stay vane, but the condition under which water turbine elements are used toward high head and high output has become more and more severe. Namely, cavities are caused around the surface of runner blades because of high velocity of water flow and the surface of runner blades is damaged be repeated impulsive load generated when cavities collapse on the surface of runner blades. This is the so-called "cavitation erosion". Conventional materials were insufficient to resist this cavitation erosion. It is therefore desired in the trend of higher head and higher output to develop a material having improved mechanical strength and toughness and particularly excellent cavitation erosion resistance.

An object of the present invention is to provide martensitic stainless cast steel having high mechanical strength and toughness and excellent cavitation erosion resistance.

Another object of the present invention is to provide water turbine elements made of martensitic stainless cast steel having excellent cavitation erosion resistance, said water turbine elements being used in water power plants.

According to the present invention martensitic stainless cast steel is provided consisting essentially of carbon of 0.1 wt% or less, silicon of 1.0 wt% or less, manganese of 2.0–9.0 (exclusive of 2.0) wt%, nickel of 0.5–8.0 wt%, chromium of 11.0–14.0 wt%, and the balance of essentially iron, and having high cavitation erosion resistance.

According to the present invention water turbine elements are provided for use in water power plants, said water turbine elements being made of abovementioned martensitic stainless cast steel.

Martensitic stainless cast steel of the present invention has excellent cavitation erosion resistance and is excellent in mechanical strength and toughness. It can also be produced easily and industrially without using a special casting manner.

This invention can be more fully understood from the following detailed description when taken in conjunction with the accompanying drawing, in which.

Figure 1:
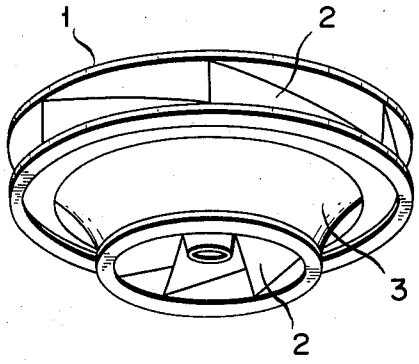
FIG. 1 is a perspective view showing a turbine runner for water power plant of the present invention.

It will be described below how additive elements should be contained and why these elements should be limited in amount to yield stainless cast steel of the present invention.

Carbon employed to yield stainless cast steel of the present invention serves to form stably martensite phase by heat treatment to enhance the strength of stainless cast steel. However, excess addition of carbon reduces the toughness of martensitic stainless cast steel and carbon should be therefore contained at most 0.1 wt%. It is preferable to add carbon in the amount of 0.05–0.1 wt%.

Silicon is added as deoxidizer together with manganese at the time of steel melting and serves to enhance the castability of cast steel. Excess addition of silicon reduces, like carbon, the toughness of stainless cast steel and silicon should be added at most 1.0 wt%. It is particularly preferable to compound silicon in the amount of 0.3–1.0 wt%.

Manganese is a component to act a particularly important role of enhancing the cavitation erosion resistance of stainless cast steel of the present invention. The reason why the compounded amount of manganese should be limited from 2.0 wt% to 9.0 wt% (exclusive of 2.0 wt%) is that effect is not made remarkable when less than 2.0 wt% and that epsilon and austenite phases are formed in cast steel to reduce proof stress when over 9.0 wt%. It is practically preferable to add manganese in the amount of 2.5–6.0 wt%.

Nickel is a component to dissolve in matrix in a solid state to make a martensite phase stable and enhance toughness. The compounded amount of nickel is limited from 0.5 wt% to 8.0 wt%, because effect of addition is made low when less 0.5 wt% and because increase of hardness makes the machinability of martensitic stainless cast steel worse remarkably and increase of residual austenite reduces proof stress when over 8.0 wt%. It is practically preferable to add nickel in the amount of 1.0–6.0 wt% and more preferably in the amount of 3.0–4.0 wt%.

Chromium is important to enhance corrosion resistance. The reason why chromium should be added ranging from 11.0 wt% to 14.0 wt% is that effect of addition is not enough when less than 11.0 wt% and that delta ferrite is formed in matrix in relation with the amount of nickel to thereby reduce cavitation erosion resistance when over 14.0 wt%. The compounded amount of chromium preferably ranges from 12.0 wt% to 13.5 wt%.

In addition to above-mentioned components, stainless cast steel of the present invention may further include one or more components selected from the group consisting of molybdenum, copper, niobium and nitrogen.

Molybdenum is an important element in enhancing the cavitation erosion resistance, mechanical strength and temper softening resistance of martensitic stainless cast steel, and in preventing the temper brittleness. The amount of molybdenum is 2.0 wt% or less, preferably in the range of 0.5–2.0 wt% and more preferably in the range of 0.5–1.6 wt%. Impact value is reduced when over 2.0 wt%.

Copper serves to enhance the cavitation erosion resistance of martensitic stainless case steel of the present invention. Copper is added ranging from 0.1 wt% to 0.5 wt%. Addition effect is low when less than 0.1 wt% and toughness is reduced when over 0.5 wt%.

Niobium is a component to make fine the grain size of cast steel to enhance proof stress and cavitation erosion resistance. The added amount of niobium ranges from 0.01 wt% to 0.1 wt%. Addition effect is not enough when less than 0.01 wt% and ferrite is formed in matrix to reduce the cavitation erosion resistance of cast steel when over 0.1 wt%. Same effect can be obtained by adding at least one or more components selected from vanadium, titanium, hafnium, tantalum and zirconium, instead of or in addition to niobium.

Nitrogen serves to enhance cavitation erosion and corrosion resistances of cast steel. The added amount of nitrogen is in the range of 0.02–0.15 wt%. Addition effect is not enough when less than 0.01 wt% and pinholes and belo-holes are caused in cast steel when over 0.2 wt%. It is preferable that the amount sum of nitrogen and carbon is in the range of 0.02–0.15 wt%.

There will be briefly described a method of manufacturing stainless cast steel of the present invention. Melting can be carried out by induction furnace or electric-arc furnace, for example, and casting may be achieved by the usual manner such as sand casting and metal mold casing.

After casting, cooling is carried out at a cooling rate of causing no crack, said cooling rate depending upon shape and size of cast steel, and it is preferable that tempering is carried out of the temperature of 500°–700° C.

Examples and controls will be described to prove the effect of the present invention.

EXAMPLES

Materials having chemical compositions shown in Examples 1–56 of Table 1 were melted in the induction furnace and heat-treated to have heat history corresponding to the as-cast cooling of large scale cast product. These samples were further solution-treated at the temperature of 1,050° C., cooled at the cooling rate of 150° C./h, and then heat-treated for tempering under the temperature of 650° C., to thereby produce various specimens.

Specimens thus produced were examined about their tensile stress, 0.2% proof stress, elongation, reduction of area, impact value (Charpy 2 mmV notch, 20° C.), diamond pyramid hardness and cavitation erosion index (C.E.I.). Results thus obtained are shown in Table 2.

Electrostrictive vibration whose frequency was 6.5 kHz and travelling distance 100 μm was added to the specimen for 180 minutes in pure water of 25° C. to measure the weight loss caused by cavitation erosion (g), and cavitation erosion index (C.E.I.) was obtained from the following equation:

$$C.E.I. = w/t\rho \times 10^6$$

where w represents the weight loss caused by cavitation erosion (g), t test time (min.) and $\rho$ specific gravity.

Controls:

Materials having chemical compositions shown in Controls 1–7 of Table 1 were melted, cast and heat-treated by same manner as in above Examples to produce specimens. Specimens thus produced were examined about their properties same as those of specimens in above Examples. Results thus obtained are also shown in Table 2.

TABLE 1

| | composition (% by weight) | | | | | | | | | |
|---|---|---|---|---|---|---|---|---|---|---|
| | C | N | Si | Cr | Ni | Mn | Mo | Nb | Cu | Fe |
| Example | | | | | | | | | | |
| 1 | 0.05 | — | 0.31 | 13.44 | 1.97 | 5.33 | — | — | — | balance |
| 2 | 0.06 | — | 0.34 | 133.3 | 1.99 | 2.99 | 1.73 | — | — | " |
| 3 | 0.06 | — | 0.32 | 12.95 | 3.26 | 5.15 | — | — | — | " |
| 4 | 0.06 | — | 0.33 | 12.87 | 3.34 | 2.95 | 1.69 | — | — | " |
| 5 | 0.06 | — | 0.33 | 13.41 | 0.51 | 8.74 | 1.13 | — | — | " |
| 6 | 0.06 | — | 0.31 | 13.16 | 1.45 | 7.09 | 0.17 | — | — | " |
| 7 | 0.05 | — | 0.32 | 13.04 | 5.16 | 2.51 | 1.12 | — | — | " |
| 8 | 0.05 | — | 0.31 | 13.01 | 2.66 | 5.16 | 0.55 | — | — | " |
| 9 | 0.05 | — | 0.31 | 13.07 | 2.69 | 5.92 | 0.53 | — | — | " |
| 10 | 0.05 | — | 0.31 | 13.11 | 3.03 | 5.05 | 0.56 | — | — | " |
| 11 | 0.05 | — | 0.29 | 13.18 | 3.09 | 5.44 | 0.54 | — | — | " |
| 12 | 0.05 | — | 0.29 | 12.97 | 3.51 | 5.06 | 0.55 | — | — | " |
| 13 | 0.05 | — | 0.34 | 13.08 | 3.58 | 5.77 | 0.61 | — | — | " |
| 14 | 0.05 | — | 0.32 | 13.03 | 3.59 | 6.06 | 0.63 | — | — | " |
| 15 | 0.06 | — | 0.33 | 13.04 | 4.16 | 5.56 | 0.64 | — | — | " |
| 16 | 0.06 | — | 0.34 | 12.96 | 1.10 | 7.09 | 1.00 | — | — | " |
| 17 | 0.07 | — | 0.32 | 13.13 | 4.76 | 3.66 | 0.59 | — | — | " |
| 18 | 0.06 | — | 0.34 | 13.19 | 4.86 | 4.32 | 0.59 | — | — | " |
| 19 | 0.06 | — | 0.33 | 13.25 | 5.27 | 3.11 | 0.63 | — | — | " |
| 20 | 0.06 | — | 0.35 | 13.23 | 5.28 | 3.43 | 0.62 | — | — | " |
| 21 | 0.06 | — | 0.35 | 13.03 | 5.84 | 2.99 | 0.64 | — | — | " |
| 22 | 0.058 | — | 0.33 | 13.54 | 3.65 | 2.57 | 0.198 | — | 0.10 | " |
| 23 | 0.057 | — | 0.32 | 13.67 | 3.60 | 2.58 | 0.193 | — | 0.30 | " |
| 24 | 0.060 | — | 0.33 | 13.93 | 3.59 | 4.50 | — | — | 0.10 | " |
| 25 | 0.057 | — | 0.34 | 13.64 | 3.58 | 4.55 | — | — | 0.33 | " |
| 26 | 0.05 | — | 0.34 | 13.18 | 2.44 | 5.46 | 0.56 | 0.02 | — | " |
| 27 | 0.05 | — | 0.32 | 13.23 | 2.42 | 5.97 | 0.54 | 0.03 | — | " |
| 28 | 0.06 | — | 0.34 | 13.07 | 2.93 | 5.05 | 0.55 | 0.03 | — | " |
| 29 | 0.05 | — | 0.31 | 13.22 | 2.95 | 5.47 | 0.56 | 0.03 | — | " |
| 30 | 0.06 | — | 0.32 | 13.24 | 2.92 | 5.46 | 1.52 | 0.03 | — | " |
| 31 | 0.05 | — | 0.30 | 13.20 | 3.42 | 4.98 | — | 0.05 | — | " |
| 32 | 0.05 | — | 0.32 | 13.17 | 3.43 | 4.97 | 1.53 | 0.03 | — | " |
| 33 | 0.05 | — | 0.36 | 13.06 | 3.55 | 5.65 | 0.63 | 0.05 | — | " |

TABLE 1-continued

| | composition (% by weight) | | | | | | | | | |
|---|---|---|---|---|---|---|---|---|---|---|
| | C | N | Si | Cr | Ni | Mn | Mo | Nb | Cu | Fe |
| 34 | 0.06 | — | 0.34 | 12.86 | 3.64 | 5.19 | 0.65 | 0.05 | — | " |
| 35 | 0.06 | — | 0.34 | 13.05 | 4.15 | 5.54 | 0.63 | 0.05 | — | " |
| 36 | 0.06 | — | 0.31 | 13.00 | 2.68 | 5.49 | 0.51 | 0.03 | 0.18 | " |
| 37 | 0.05 | — | 0.28 | 13.06 | 2.60 | 6.00 | 0.52 | 0.04 | 0.19 | " |
| 38 | 0.06 | — | 0.31 | 13.22 | 3.07 | 5.00 | 0.47 | 0.04 | 0.19 | " |
| 39 | 0.05 | — | 0.28 | 13.05 | 3.01 | 5.46 | 0.50 | 0.04 | 0.19 | " |
| 40 | 0.05 | — | 0.33 | 13.16 | 3.51 | 5.15 | 0.58 | 0.04 | 0.17 | " |
| 41 | 0.06 | — | 0.36 | 13.13 | 3.56 | 5.40 | 0.57 | 0.05 | 0.18 | " |
| 42 | 0.06 | — | 0.33 | 13.06 | 3.66 | 5.97 | 0.63 | 0.05 | 0.20 | " |
| 43 | 0.06 | — | 0.34 | 12.95 | 4.08 | 5.50 | 0.63 | 0.05 | 0.20 | " |
| 44 | 0.06 | — | 0.32 | 12.09 | 3,74 | 6.16 | 0.52 | 0.06 | 0.20 | " |
| 45 | 0.06 | — | 0.33 | 13.32 | 4.86 | 3.94 | 0.58 | 0.05 | 0.20 | " |
| 46 | 0.06 | — | 0.35 | 13.26 | 4.74 | 4.12 | 0.57 | 0.05 | 0.20 | " |
| 47 | 0.06 | — | 0.34 | 13.01 | 5.30 | 3.04 | 0.63 | 0.05 | 0.20 | " |
| 48 | 0.06 | — | 0.35 | 13.11 | 5.33 | 3.49 | 0.59 | 0.05 | 0.20 | " |
| 49 | 0.06 | — | 0.36 | 13.03 | 5.82 | 3.09 | 0.62 | 0.05 | 0.20 | " |
| 50 | — | 0.12 | 0.31 | 13.22 | 3.56 | 5.17 | — | — | — | " |
| 51 | 0.02 | 0.06 | 0.33 | 13.17 | 2.02 | 3.04 | 1.63 | — | — | " |
| 52 | 0.04 | 0.02 | 0.33 | 13.44 | 1.51 | 7.15 | 0.21 | — | — | " |
| 53 | 0.02 | 0.07 | 0.33 | 13.11 | 5.24 | 2.56 | 1.13 | — | — | " |
| 54 | 0.02 | 0.05 | 0.32 | 13.27 | 3.49 | 4.93 | — | 0.05 | — | " |
| 55 | 0.02 | 0.06 | 0.30 | 13.39 | 3.48 | 4.94 | 1.55 | 0.03 | — | " |
| 56 | 0.02 | 0.07 | 0.33 | 13.26 | 3.55 | 2.63 | 0.20 | — | 0.11 | " |
| Control | | | | | | | | | | |
| 1 | 0.05 | — | 0.32 | 13.09 | 1.81 | 0.59 | 0.56 | — | — | " |
| 2 | 0.04 | — | 0.32 | 13.27 | 3.52 | 0.57 | 0.55 | — | — | " |
| 3 | 0.05 | — | 0.31 | 13.42 | 1.94 | 1.48 | — | — | — | " |
| 4 | 0.06 | — | 0.33 | 13.05 | 1.91 | 3.03 | 3.53 | — | — | " |
| 5 | 0.05 | — | 0.30 | 13.20 | 3.45 | 1.51 | — | — | — | " |
| 6 | 0.06 | — | 0.34 | 13.17 | 3.43 | 2.98 | 3.58 | — | — | " |
| 7 | 0.05 | — | 0.30 | 13.12 | 5.93 | 0.58 | 1.56 | — | — | " |

TABLE 2

| | ultimate tensile stress (kg/mm²) | 0.2% proof stress (kg/mm²) | reduction (%) | elongation (%) | impact value (2 mmV notch) (kg-m/cm²) | diamond pyramid hardness | C.E.I. |
|---|---|---|---|---|---|---|---|
| Example | | | | | | | |
| 1 | 86.5 | 59.2 | 78.5 | 15.0 | 20.2 | 274 | 44.31 |
| 2 | 81.5 | 51.9 | 73.1 | 17.3 | 27.9 | 264 | 44.73 |
| 3 | 98.9 | 60.1 | 72.5 | 15.6 | 17.2 | 316 | 34.12 |
| 4 | 91.9 | 55.7 | 73.7 | 14.3 | 21.2 | 291 | 38.69 |
| 5 | 100.2 | 51.7 | 64.8 | 15.0 | 5.3 | 318 | 27.75 |
| 6 | 105.5 | 42.1 | 64.8 | 17.9 | 10.7 | 326 | 26.46 |
| 7 | 97.1 | 52.1 | 62.7 | 15.5 | 23.9 | 302 | 28.84 |
| 8 | 100.2 | 61.9 | 67.0 | 13.6 | 14.3 | 330 | 34.99 |
| 9 | 102.9 | 53.3 | 70.0 | 15.1 | 10.2 | 332 | 30.79 |
| 10 | 102.6 | 64.2 | 69.8 | 14.6 | 13.3 | 331 | 34.15 |
| 11 | 103.7 | 53.9 | 63.9 | 14.7 | 11.1 | 320 | 33.63 |
| 12 | 102.2 | 62.0 | 66.2 | 12.8 | 11.0 | 334 | 33.04 |
| 13 | 109.7 | 59.0 | 61.7 | 15.1 | 9.84 | 330 | 28.88 |
| 14 | 113.2 | 52.6 | 51.0 | 13.8 | 9.09 | 335 | 25.79 |
| 15 | 114.4 | 50.0 | 57.7 | 15.7 | 9.76 | 344 | 25.88 |
| 16 | 102.7 | 68.4 | 58.5 | 14.1 | 5.70 | 325 | 34.27 |
| 17 | 98.9 | 62.0 | 71.0 | 12.2 | 13.70 | 312 | 40.41 |
| 18 | 101.6 | 62.0 | 68.3 | 14.0 | 13.64 | 319 | 31.65 |
| 19 | 96.4 | 60.4 | 71.8 | 13.8 | 15.33 | 310 | 39.99 |
| 20 | 99.0 | 60.7 | 65.4 | 13.4 | 12.15 | 316 | 35.64 |
| 21 | 99.5 | 63.3 | 66.1 | 12.2 | 11.80 | 313 | 34.54 |
| 22 | 84.3 | 61.8 | 71.8 | 12.9 | 23.2 | 268 | 39.52 |
| 23 | 83.2 | 63.5 | 70.4 | 12.2 | 23.4 | 267 | 39.92 |
| 24 | 102.1 | 56.6 | 66.9 | 13.9 | 6.9 | 330 | 28.11 |
| 25 | 101.0 | 63.9 | 60.9 | 11.6 | 8.8 | 320 | 28.07 |
| 26 | 100.5 | 63.7 | 66.9 | 13.5 | 12.6 | 322 | 35.82 |
| 27 | 105.1 | 53.8 | 66.2 | 14.6 | 10.5 | 327 | 29.88 |
| 28 | 103.5 | 62.5 | 67.0 | 13.7 | 11.6 | 337 | 33.71 |
| 29 | 105.6 | 55.3 | 64.0 | 15.2 | 10.6 | 338 | 30.16 |
| 30 | 107.1 | 61.4 | 64.1 | 15.8 | 10.6 | 341 | 27.50 |
| 31 | 106.4 | 68.0 | 64.7 | 14.4 | 12.8 | 327 | 29.85 |
| 32 | 108.0 | 66.7 | 65.5 | 15.6 | 11.5 | 335 | 29.28 |
| 33 | 109.7 | 55.7 | 61.8 | 16.1 | 10.34 | 327 | 25.79 |

TABLE 2-continued

| | ultimate tensile stress (kg/mm²) | 0.2% proof stress (kg/mm²) | reduction (%) | elongation (%) | impact value (2 mmV notch) (kg-m/cm²) | diamond pyramid hardness | C.E.I. |
|---|---|---|---|---|---|---|---|
| 34 | 116.9 | 51.5 | 51.8 | 13.8 | 9.26 | 346 | 23.94 |
| 35 | 113.1 | 49.1 | 57.7 | 14.3 | 9.92 | 338 | 26.19 |
| 36 | 101.6 | 59.4 | 68.4 | 13.9 | 12.5 | 330 | 34.39 |
| 37 | 103.4 | 54.6 | 64.0 | 15.1 | 10.0 | 332 | 31.47 |
| 38 | 102.9 | 61.5 | 67.7 | 13.5 | 11.7 | 329 | 35.09 |
| 39 | 106.1 | 58.2 | 64.0 | 15.7 | 10.7 | 335 | 26.98 |
| 40 | 106.1 | 67.9 | 64.0 | 13.4 | 12.93 | 325 | 30.45 |
| 41 | 108.9 | 57.2 | 59.3 | 15.4 | 10.64 | 325 | 27.53 |
| 42 | 115.7 | 50.0 | 49.2 | 14.5 | 9.18 | 334 | 24.17 |
| 43 | 113.3 | 48.7 | 57.6 | 15.4 | 9.59 | 332 | 33.82 |
| 44 | 111.3 | 48.7 | 57.0 | 14.6 | 9.17 | 335 | 27.80 |
| 45 | 100.0 | 64.1 | 68.3 | 12.6 | 15.23 | 320 | 35.78 |
| 46 | 100.6 | 62.3 | 67.5 | 13.9 | 12.93 | 317 | 35.19 |
| 47 | 97.9 | 58.0 | 70.4 | 13.9 | 13.11 | 315 | 36.77 |
| 48 | 100.2 | 57.4 | 69.8 | 14.2 | 11.11 | 322 | 33.23 |
| 49 | 98.6 | 61.2 | 71.2 | 15.1 | 12.06 | 313 | 35.44 |
| 50 | 95.6 | 56.8 | 73.1 | 15.8 | 17.9 | 314 | 35.26 |
| 51 | 80.7 | 50.3 | 73.3 | 16.2 | 26.8 | 266 | 42.89 |
| 52 | 99.2 | 45.7 | 65.2 | 17.4 | 11.1 | 324 | 28.77 |
| 53 | 95.4 | 51.1 | 63.9 | 14.8 | 19.7 | 311 | 29.23 |
| 54 | 103.9 | 65.2 | 66.7 | 14.1 | 12.8 | 313 | 30.46 |
| 55 | 106.3 | 62.0 | 64.6 | 14.5 | 10.8 | 329 | 29.34 |
| 56 | 82.6 | 59.3 | 70.8 | 12.2 | 22.2 | 265 | 40.24 |
| Control | | | | | | | |
| 1 | 75.6 | 53.7 | 69.1 | 16.7 | 22.8 | 243 | 64.30 |
| 2 | 86.3 | 54.6 | 62.5 | 14.0 | 15.2 | 270 | 55.16 |
| 3 | 70.5 | 52.3 | 77.6 | 17.3 | 30.5 | 233 | 63.86 |
| 4 | 82.7 | 50.9 | 64.7 | 16.9 | 1.3 | 268 | 45.28 |
| 5 | 78.2 | 59.5 | 79.2 | 15.1 | 30.1 | 254 | 58.27 |
| 6 | 95.2 | 55.3 | 62.5 | 15.0 | 2.0 | 302 | 33.85 |
| 7 | 91.4 | 50.3 | 65.8 | 15.8 | 14.7 | 304 | 49.20 |

As apparent from Table 2, each specimen of Examples according to the present invention is less than 45 in C.E.I. as compared with that of Controls, and it can particularly be understood that each specimen of Examples has remarkably excellent cavitation erosion resistance as compared with 13-chromium steels (Controls 1 and 2) which has widely been used as structural material for conventional water turbine elements and whose C.E.I. is over 55. It can also be understood that Example specimens are equal to or more excellent in mechanical strength and toughness than Control specimens.

The specimen of Control 6 is excellent in cavitation erosion resistance, but remarkably low in impact value. It is therefore unsuitable for use as structural material for water turbine elements such as runner, stay vane and guide vane which are needed to have high toughness.

As described above, martensitic stainless cast steel according to the present invention has excellent cavitation erosion resistance and is excellent in mechanical strength and toughness. It can also be manufactured easily and industrially without using a special casting manner. Therefore, it is most suitable for use as propeller material for ships as well as material for water power plant turbine elements such as runner, stay vane and guide vane.

Figure 2:
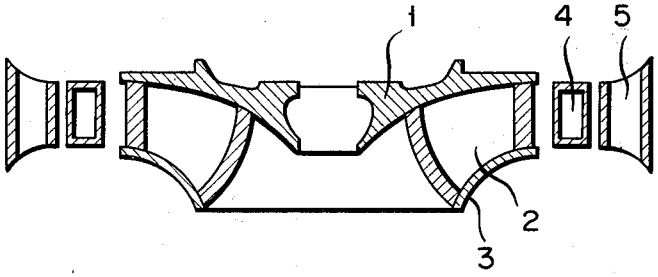
FIG. 2 is a sectional view showing the turbine runner shown in FIG. 1.

FIG. 1 is a perspective view showing a runner of turbine made of stainless cast steel of the present invention and employed for water power plants. FIG. 2 is a sectional view of runner shown in FIG. 1 and including other turbine elements. In FIGS. 1 and 2 numeral 1 represents a crown, 2 blades, 3 a shroud, 4 a stay vane and 5 a guide vane.

What we claim is:

1. Martensitic stainless cast steel having high cavitation erosion resistance and consisting essentially of carbon of 0.1 wt% or less, silicon of 1.0 wt% or less, manganese of 2.0–9.0 (exclusive of 2.0) wt%, nickel of 0.5–8.0 wt%, chromium of 11.0–14.0 wt%, molybdenum of 2.0 wt% or less and the balance of essentially iron.

2. Martensitic stainless cast steel having high cavitation erosion resistance and consisting essentially of carbon of 0.1 wt% or less, silicon of 1.0 wt% or less, manganese of 2.0–9.0 (exclusive of 2.0) wt%, nickel of 0.5–8.0 wt%, chromium of 11.0–14.0 wt%, niobium of 0.01–0.1 wt% and the balance of essentially iron.

3. Martensitic stainless cast steel having high cavitation erosion resistance and consisting essentially of carbon of 0.1 wt% or less, silicon of 1.0 wt% or less, manganese of 2.0–9.0 (exclusive of 2.0) wt%, nickel of 0.5–8.0 wt%, chromium of 11.0–14.0 wt%, copper of 0.1–0.5 wt% and the balance of essentially iron.

4. Martensitic stainless cast steel having high cavitation erosion resistance and consisting essentially of carbon of 0.1 wt% or less, silicon of 1.0 wt% or less, manganese of 2.0–9.0 (exclusive of 2.0) wt%, nickel of 0.5–8.0 wt%, chromium of 11.0–14.0 wt%, nitrogen of 0.02–0.15 wt% and the balance of essentially iron.

5. Martensitic stainless cast steel according to claim 4 wherein the amount sum of nitrogen and carbon is in the range of 0.02–0.15 wt%.

6. Martenistic stainless cast steel according to claim 1 wherein molybdenum is in the range of 0.5–2.0 wt%.

7. Martensitic stainless cast steel according to claim 6 wherein molybdenum is in the range of 0.5–1.6 wt%.

8. Martensitic stainless cast steel according to claim 1, 6, 7, 5, 2, 3, or 4 wherein carbon is in the range of 0.05–0.1 wt% and silicon in the range of 0.3–1.0 wt%.

9. Martensitic stainless cast steel according to claim 4 wherein manganese is in the range of 2.5–6.0 wt%, nickel in the range of 1.0–6.0 wt%, and chromium in the range of 12.0–13.5 wt%.

10. Martensitic stainless cast steel according to claim 3 wherein nickel is in the range of 3.0–4.0 wt%.

11. Martensitic stainless cast steel according to claim 5, 2, 3, 4 further containing molybdenum which is 2.0 wt% or less.

12. Martensitic stainless cast steel according to claim 5, 3, 4 further containing niobium in the range of 0.01–0.1 (exclusive of 0.1) wt%.

13. Martensitic stainless cast steel according to claim 5-4 further containing copper in the range of 0.1–0.5 wt%.

14. A turbine element for water power plants made of martensitic stainless cast steel according to claim 1, 6, 7, 5, 2, 3 or 4.

15. A turbine element according to claim 14 wherein said said turbine element is runner, stay vane or guide vane.

16. Martensitic stainless cast steel according to claim 1 wherein molybdenum is in the range of 0.5–2.0 wt%.

17. Martensitic stainless cast steel according to claim 16 wherein molybdenum is in the range of 0.5–1.6 wt%.

* * * * *